US005140835A

United States Patent [19]

Stransky

[11] Patent Number: 5,140,835

[45] Date of Patent: Aug. 25, 1992

[54] PROCESS FOR SHAPING LACQUERED METAL SUBSTRATES

[75] Inventor: Karl-Heinz Stransky, Wuppertal, Fed. Rep. of Germany

[73] Assignee: Herberts GmbH, Wuppertal, Fed. Rep. of Germany

[21] Appl. No.: 632,028

[22] Filed: Dec. 21, 1990

[30] Foreign Application Priority Data

Dec. 23, 1989 [DE] Fed. Rep. of Germany ..... 3942921

[51] Int. Cl.[5] ..... B21B 45/00

[52] U.S. Cl. ..... 72/46; 204/180.6; 204/180.2

[58] Field of Search ..... 204/180.6, 181.7, 180.2, 204/180.4; 72/46; 427/388.1

[56] References Cited

U.S. PATENT DOCUMENTS

| | | | |
|---|---|---|---|
| 3,206,848 | 9/1965 | Rentmeester | 72/46 |
| 3,936,368 | 2/1976 | Watanabe et al. | 204/180.6 |
| 4,562,714 | 1/1986 | Tanaka et al. | 72/46 |

FOREIGN PATENT DOCUMENTS

| | | | |
|---|---|---|---|
| 3832470 | 4/1984 | Fed. Rep. of Germany | 427/388.1 |
| 0143840 | 11/1971 | Japan | 204/180.2 |
| 0011416 | 5/1975 | Japan | 204/180.6 |
| 0005850 | 1/1977 | Japan | 204/180.6 |
| 0006757 | 1/1982 | Japan | 427/388.1 |
| 0162796 | 8/1985 | Japan | 204/180.2 |

*Primary Examiner*—Lowell A. Larson
*Assistant Examiner*—Michael J. McKeon
*Attorney, Agent, or Firm*—Schweitzer Cornman & Gross

[57] ABSTRACT

A process for shaping a metal substrate lacquered by a cathodic electro dip process and then baked, involving heating the lacquered and baked substrate to a temperature between a lower limit of from about 30° C., suitably 20° C., below the glass transition temperature of the lacquer and an upper limit of just below the decomposition temperature thereof, and then shaping the coated and baked substrate in the thus heated state. Shaping of the lacquered, baked substrate is suitably carried out by rolling, pressing, crimping, or dimpling.

5 Claims, No Drawings

PROCESS FOR SHAPING LACQUERED METAL SUBSTRATES

FIELD OF THE INVENTION

This invention relates to a process for shaping metal substrates which have been lacquered by cathodic electro dip lacquering followed by baking.

BACKGROUND OF THE INVENTION

Electro dip lacquering is a known process which has often been described in the prior art, see for example European patent Nos. 4,090 and 66,859. It produces a uniform coating on various metal surfaces and thus protect them against corrosion. Subsequent layers can be applied to the first or primer layer thus applied. The general procedure involves dipping the electrically conductive parts into an aqueous electro dip bath, connecting them as cathode or anode and causing the lacquer to be coagulated on the surface of the substrate by the direct current. One advantage of the process is that when hollow bodies are being coated, the electric resistance increases on their external surface and surfaces to which there is no easy access, for example the inner parts or cavities which have only small openings, are to an increasing extent being coated by this process. The material which adheres to the surface is then heated so that it is physically caused to flow and it is optionally also cross-linked chemically so that a homogeneous, smooth, wear resistant surface is obtained.

One advantage of the process of electro dip lacquering is that it can also coat parts of surfaces which are difficult to reach. Thus, good protection against corrosion can also be obtained on these parts. The coating of cavities and edges can be facilitated by varying some of the deposition parameters. Major mechanical shaping processes are generally not carried out on their metal substrates, because the coating can crack and burst, whereby the protection against corrosion will be considerably reduced. It is precisely in those parts which are subject to mechanical stress that folds, cavities, and other coating discontinuities frequently occur and these are particularly likely to corrode.

It has been found necessary for certain applications to carry out mechanical shaping after coating and baking of the electro dip lacquer. This normally results in cracks and mechanical damage in the dense, baked electro dip lacquered surface. These defects then constitute vulnerable points where corrosion is like to occur. It would be possible to prevent this by applying a subsequent coating at these points but this procedure is complicated and cannot be carried out at every point of vulnerability.

Another known procedure involves coating the metallic substrate with an anodic electro dip lacquer coating compound. After cross-linking has taken place, these coatings can still withstand mechanical stresses to such an extent that the mechanical deformation will cause no damage to the surface of the film. These anodic electro dip lacquer coating compounds, however, have the disadvantage that they are inferior to cathodic electro dip lacquer coatings in the protection that they afford against corrosion. Moreover, the throwing power of the coating compounds, ie.e the possibility of coating cavities which are difficult to reach, is considerably inferior to that obtained in cathodic electro dip lacquering. Cathodic electro dip lacquering has therefore become the method of predominant choice. It is in the shaping of cathodically electro dip lacquer substrates, however, that the disadvantages described above occur.

DESCRIPTION OF THE INVENTION

Accordingly, it is an object of the present invention to provide a process for the mechanical shaping of cathodically electro dip lacquered metal articles in which the baked lacquer coating is not damaged, the formation of cracks is avoided, and good protection is provided against corrosion since the cathodically is deposited and baked electro dip lacquer protects the coated metal.

It was surprisingly found that this objective is achieved by a process of the aforementioned general nature wherein the baked lacquer and the surface of the metal substrate is heated to a temperature of from between about 30° C., suitably 20° C., below the glass transition temperature of the baked lacquer and just below the decomposition temperature thereof, and then shaping the coated and baked article in the thus heated state.

The upper limit of the heating temperature is not critical but, of course, has to be below the decomposition temperature of the baked lacquer.

It is a surprising discovery of the present invention that cathodically deposited electro dip lacquer coatings can be mechanically shaped even after baking or cross linking if they are heated to the required temperature as described above. Metal substrates such as, for example, steel, aluminum magnesium, or other metals, including alloys, thus can be provided with good protection against corrosion and then can be mechanically shaped without the surface of the film being damaged in the process.

The metal substrates can be articles of various forms, for example metal sheets.

As used throughout the specification and the claims, "shaping" denotes any process for providing a shape to a sheet-like or tubular or other pre-formed substrate which shaping process is not as radical an intervention as, for example, stamping or drilling or holes, both of which might result in corrosion. Processes such as rolling, pressing, crimping, or dimpling of small or large surface are as are meant to be included in the term.

One particularly suitable method of mechanical shaping is the dimpling together of metal parts. In that case, for example, two different metal sheets are provided together with molding dimples usually over a small surface area. The sheets thus become affixed to each other against relative lateral movement. The surface area over which the pressure is applied in dimpling is generally from about 0.1 to about 1 cm and the depth to which the material impressed in is suitably from about 1 to about 5 mm, depending on the nature of the substrate and its thickness. It has not been possible until now to dimple metal substrates which have been corrosion protected by cathodic electro dip lacquering without causing the lacquer coating and/or the substrates to crack and burst at and around the points at which they have been impressed. It is only the heating according to the invention which enables this to be achieved.

Another suitable method of mechanical shaping cathodically electro dip coated and baked metal substrates is the pressing or crimping together of metal tubes of a diameter of e.g. about 0.5 cm, and have to be pressed together at predetermined points. In prior art processes damage to the lacquer surface usually appears at the edges of these surfaces.

The substrates which can be shaped according to the invention can be coated with otherwise known cathodically depositable lacquers or coating compounds. The usual cathodically depositable electro dip lacquer coating compounds can include, for example, conventional alkaline base resins, optionally mixed with other resins or cross-linking agents, inorganic and/or organic pigments or fillers, neutralizing agents, and other additives required for a lacquer formulation. The neutralizing agents are suitable mainly organic acids, e.g. formic acid, acetic acid, lactic acid and/or alkylphosphoric acid. Examples of conventional lacquer additives include anti-foaming agents, wetting agents, solvents for adjusting the viscosity, inhibitors, and catalysts.

Suitable binders include conventional self-cross-linking alkaline base resins and/or conventional base resins which can be cross-linked by added cross-linking agents, together with conventional cross-linking agents. Examples of conventional base resins include aminoepoxide resins, aminoepoxide resins containing terminal double bonds, aminopolyurethane resins, modified epoxide/carbon dioxide/amine reaction products and amino group-containing polymers of olefinically unsaturated monomers, e.g. acrylate resins. They have been described, for example, in European patents Nos. 12,463; 82,291; 209,857; 234,395; and 261,385. The base resins can be self-cross-linking or cross-linkable by added agents capable of transesterification of trans-amidation, cross-linking agents containing active hydrogen capable of Michael addition to activated double bonds. Examples of these are described in European patents Nos. 245,786; and 4,090, and in the periodical Farbe & Lack, Year 89, 12, 1983, page 928.

At least part of the base resin must contain a sufficient quantity of neutralizable or ionic groups to ensure that the lacquer binder will be readily soluble. The quality of deposition of the electro dip lacquer coating can be influenced by the number of such groups. The cross-linking density of the deposited and baked film can be influenced by the number of cross-linkable groups. All this is determined by conventional methods well known to the person skilled in the art.

The conventional electro dip lacquers used can contain conventional pigments and fillers, such as carbon black, titanium dioxide, finely dispersed silicon dioxide, aluminum silicate, pigments containing lead and chromate, colored pigments and organic pigments. The properties of the deposited lacquer, e.g. its elasticity, can also be influenced by the quantity and nature of the pigments. The pigments are normally dispersed in special trituration binders or in parts of the lacquer binder and then ground to the necessary degree of fineness in a suitable mill. The usual additives may be added at this stage to influence the working up of the pigments.

Cathodic electro dip lacquer coating compounds are produced in known manner from conventional binders and pigments, the metal substrates are then coated in the baths of the coating compounds thus prepared. For obtaining good protection against corrosion, these substrates must be thoroughly degreased before electro dip lacquering so that the substantially applied coat of lacquer will adhere firmly.

Poor adherence of the lacquer coat would result in increased corrosion or would cause the lacquer film to burst or spall off when subjected to mechanical stresses. It is also customary to coat the metal surface with a phosphate layer before further coats are applied. This phosphate layer usually contains iron or zinc phosphate crystals which contain other, foreign ions. It forms a homogeneous cover over the surface of the substrate. The phosphate layer together with the electro dip lacquer coat subsequently applied, provides good adherence to the substrate and promotes corrosion protection. These phosphate layers customarily have a thickness of from about 1 to about 10 μm. The coating film is baked after it was applied in the cathodic electro dip bath.

Substrates coated as described above could until now not withstand mechanical shaping. This has only become possible by the process of the present invention.

In that process, the lacquer surfaces of the substrates are heated to a temperature between of from about 30° C., suitably 20° C., below the glass transition temperature of the lacquer coating. The glass transition temperature is determined by DSC (differential scanning calorimetry). When upper and lower limits were determined, the mean value is taken as the glass transition temperature.

The coated and heated pests can then be subjected to mechanical shaping, for example two metal sheets can be dimpled, and a mechanical bond is thereby obtained between the two parts. Damage to the homogeneous lacquer surface as a result of the mechanical shaping is prevented by the heating process in accordance with the present invention. No cracks, burst or spalled areas occur. Thus, also improved protection to corrosion is obtained at these points and the appearance of the object is not impaired by cracks or burst areas. As mentioned, another example of the procedure according to the present invention is the cathodic electro dip lacquering of thin metal tubes. After the deposited film was cross-linked or after an intermediate period of storage following the process of cross-linking, the film is heated in accordance with the present invention. The tubes can be compressed or bent. The edges in particular are free from cracks or burst areas.

If desired, heating of the lacquer film to a temperature above the glass transition temperature can take place in stages. The heating can be carried out immediately after baking and before shaping. Alternatively, heating of the lacquered, baked substrate can be carried out at some later date when the lacquer film is to be put into use, and this heating is then followed by the mechanical shaping.

Heating can be carried out by various means. For example, the metal substrates can be heated in their entirety in an oven. It is also sufficient to heat only the lacquer surface, e.g. by radiant heat. Mechanical shaping can be carried out at this stage and the substrate and lacquer surface can then be cooled. If various kinds of shaping are to be employed, the coated substrate can be heated once or several times.

The heating has no deleterious effect on the cross-linked, cathodically deposited film. Thus, for example, the adherence of subsequently applied layers is not impaired. further, the corrosion protection of a film which was baked under normal conditions in comparable to that of a film which was subsequently heated to a temperature above 30° C. below the glass transition temperature.

The following examples further illustrate the present invention. All percentages and parts are by weight. The solids content is determined at 150° C. according to German Federal Republic Standard DIN 53 182.

PREPARATION OF BINDER RESINS FOR CATHODIC DEPOSITION

Resin Example A 391 g diethanolamine, 189 g 3-(N,N-dimethylamino)-propylamine and 1147 g of an adduct of 2 mil of hexane-1,6-diamine and 4 mole of glycidyl ester of versatic acid (sold under the trademark Cadura E 10 by Royal Dutch Shell) are added to 5273 g bisphenol A epoxide resin (epoxide equivalent weight about 475) in 3000 g of ethoxypropanol as described in European patent No. 12,463. The reaction mixture is maintained at 85° C. to 90° C. for 4 hours with stirring and then at 120° C. for one hour. It is then diluted to a solids content of 60% with ethoxypropanol.

Resin Example B 2262 g epoxide resin based on bisphenol A (epoxide equivalent weight about 260) are dissolved in 2023 g diethylene glycol dimethylether at 60° C. to 70° C. and then heated to 100° C.–110° C. until the acid number has fallen below 3 mg KOH/g. The reaction product is then reacted with 3,262 g of a 70% solution of a monoisocyanate of tolylene diisocyanate and dimethylethanolamine (molar ratio 1:1) in diethylene glycol dimethylether until the isocyanate value is zero.

Resin Example C

228 Parts bisphenol A (1 mol) are reacted with 260 parts of diethylaminopropylamine (2 mol) and 66 parts of para-formaldehyde (91%; 2 mol) in the presence of 131 parts of toluene as azeotropic entrainment agent until 42 parts of water of reaction were separated. After the addition of 152 parts of diethylene glycol dimethylether and cooling of the product to 30° C., 608 parts (2 mol) of a tolylene diisocyanate semi-blocked with 2-ethyl hexanol are added within 45 minutes. When the isocyanate value has been reduced virtually to zero, a solution of 190 parts of an epoxide resin based on bisphenol A (epoxide equivalent weight about 190) and 250 parts (1 mol) of a glycidyl ester of a saturated tertiary $C_{9-11}$ monocarboxilic acid in 389 parts of diethylene glycol dimethylether are added to 1,400 parts of the above described solution, and the two are reacted with each other at 95° C. to 100° C. until the epoxide value is zero.

Resin Example D 786 g of trimellitic acid anhydride and 2000 g of glycidyl ester of a branched, tertiary $C_{10}$-monocarboxylic acid (Cadura E10) are carefully heated to 190° C. with stirring, an exothermic reaction beginning at 90° C. The reaction mixture is cooled to 140° C. and 2.75 g of N,N-dimethylbenzylamine are added.

The reaction mixture is maintained at 145° C. until and acid number below 3 mg KOH/g is obtained. A further, calculated quantity of the acid Cadura E10 is added if necessary. The reaction product is diluted to a solids content of 80% with 2-butoxyethanol.

Resin Example E 498 g of a reaction product of 1 mol of tris-(hydroxymethyl)-aminomethane and 1 mol of n-butylacrylate are dissolved to a concentrate of 50% in toluene and 174 g of tolylene diisocyanate are added in installments at 24° C. to 40° C. with adequate cooling. The NOC values is virtually zero at the end of the reaction. After the reaction mixture has been heated to 70° C., 60 g of paraformaldehyde and 0.01% triethylamine are added and the temperature is raised until the water of reaction (1 mol per mol of formaldehyde) has been distilled off azeotropically. After cooling, 1,064 g of a semi-masked isocyanate of hydroxyethyl methacrylate and tolylene diisocyanate of hydroxyethyl methacrylate and tolylene diisocyanate (molar ratio 1:1) are added, and the mixture is reacted until the NCO value has been reduced to approximately zero. The toluene is then distilled off and the reaction mixture is diluted to a solids content of 75% with diethylene glycol dimethylether.

Resin Example F 160 g of caprolactam are slowly added with stirring at 70° C. to 431 g of a solution (75% in ethyl acetate) of a reaction product of 3 mol of tolylene diisocyanate and 1 mol of trimethylolpropane (sold under the trademark Desmodur L by Bayer AG) at 70° C. The reaction mixture is then maintained at 70° C. until the isocyanate content has fallen virtually to zero 2-Butoxyethanol (204 g) is then added and the ethyl acetate is distilled off over a column until the solids content is 70%.

Dispersion Example G

A mixture is prepared from 450 g of the resin according to Example C and 225 g of the resin according to Example A. This mixture is freed to a large extent from solvent by distillation; 18.5 g of formic acid (50%) are added, and the reaction mixture is converted into a dispersion with a solids content of about 43% by the addition of completely salt-free water with heating.

Dispersion Example H 208 g of a resin according to Example A, 285 g of a resin according to Example B, 200 g of a resin according to Example E, and 32 g of a resin according to Example D are mixed together. The mixture obtained is to a large extent freed from solvents by distillation under vacuum. 19.0 g of acetic acid (50%) are added with stirring and the reaction mixture is then converted into a dispersion with a solids content of about 32% by dilution with completely salt-free water.

PREPARATION OF PIGMENT PASTES FOR CATHODICALLY DEPOSITABLE ELECTRO DIP LACQUERS

Pigment Paste Example P1

90.5 g of a binder according to European patent No. 183,025, Example 5 (80%) are intimately mixed with 8 g of formic acid (50%) and 300 g of completely salt-free water, and the clear lacquer is prepared. This lacquer is homogeneously mixed with 408 g of titanium dioxide, 120 g of aluminum silicate, 13.5 of carbon black and 49.5 g of lead oxide, and the mixture is adjusted to a suitable viscosity with about 100 g of water. The solids content of the pigment paste is approximately 80%. This paste is then ground the necessary degree of fineness in a pearl mill.

Pigment Paste Example P2

5.2 g of acetic acid (100%) are added to 150 g of the binder according to European patent No. 183,025, Example 3, and the components are intimately mixed together. 300 g of completely salt-free water are then added and thereafter 17.5 g of dibutyl tin oxide, 22 g of lead oxide, 150 g of aluminum silicate and 28 g of carbon black are added in a high speed stirrer apparatus with thorough mixing. The reaction mixture is adjusted to a suitable viscosity (solids content about 45%) by the addition of about 50 g of water and the pigment paste is ground to the required particle size in a suitable mill.

Pigment Paste Example P3

5.8 g of formic acid (50%) are added to 200 g of the binder mixture according to the resin of Examples A and F (ratio of solids contents 7:3) and the components are intimately mixed together. 30 g of dibutyl tin oxide, 30 g of lead oxide, 80 g of carbon black and 200 g of aluminum silicate are then added in a high speed stirrer apparatus. The mixture is adjusted to a suitable viscosity with about 200 g of butyl glycol and the pigment paste is ground to the required particle size in a suitable mill.

PREPARATION OF CATHODICALLY DEPOSITABLE ELECTRO DIP LACQUERS (KTL)

Lacquer Example I 2035 g of completely salt-free water are added to 990 g of a dispersion according to Example G, and 475 g of a pigment paste according to Example P1 are slowly added with vigorous stirring. This KTL bath is then electrophoretically deposited on phosphatized metal sheets by a conventional coating process. The coated parts are cross-linked by heating (30 mins, 180° C.). The glass transition temperature Tg after cross-linking is about 90° C.

Lacquer Example J 1450 g of a dispersion according to Example H are mixed with 900 g of completely salt-free water. 325 g of the paste according to Example P1 are then added. After the mixture has been thoroughly homogenized, it is diluted to a solids content of about 20% with approximately 300 g of water. Coating is carried out as in Lacquer Example I. The lacquer films are cross-linked at an elevated temperature (25 min, 175° C.). The glass transition temperature of the cross-linked film is about 80° C.

Lacquer Example K 1,100 g of a binder mixture of examples A and F (7:3, based on solids content) are introduced into a high speed stirrer apparatus and mixed with 350 g of a paste according to P3. 25.5 g of formic acid (50%) are added and the mixture is then diluted with 3,525 of water. After the mixture has been stirred for about 24 hours, substrates are coated in the KTL bath thus obtained. These substrates are baked and cross-linked (30 min, 165° C.). The glass transition temperature is 80° C.

COMPARATIVE TESTING OF THE INVENTION

Metal sheets of a thickness of about 3 mm were employed. After baking they were cooled to room temperature and then briefly heated and shaped by dimpling.

| Lacquer of Example | Heating to °C. | Dimpling |
|---|---|---|
| I (Tg = 90) | 20 | cracks |
| | 40 | cracks |
| | 80 | no cracks |
| J (Tg = 80) | 20 | cracks |
| | 40 | cracks |
| | 80 | no cracks |
| K (Tg = 80) | 20 | cracks |
| | 40 | cracks |
| | 80 | no cracks |

It is clear that only the employment of the process of the present invention permitted shaping of the lacquer metal substrate without any damage to the coating.

I claim:

1. A process for shaping a metal substrate lacquered by a cathodic electro dip process and then baked, which comprises heating the lacquered and baked substrate to a temperature between a lower limit of from about 30° C. below the glass transition temperature of the lacquer and an upper limit of just below the decomposition temperature thereof, and then shaping the coated and baked substrate in the thus heated state.

2. The process of claim 1, wherein said shaping comprises rolling, pressing, crimping, or dimpling.

3. The process of claim 2, wherein the shaping is dimpling together two sheet metal substrates against relative lateral movement.

4. The process of claim 1, wherein said lower limit is from about 20° C. below said glass transition temperature.

5. The process of claim 4, wherein said shaping comprises rolling, pressing, crimping, or dimpling.

* * * * *